US006067826A

United States Patent [19]

Holloway et al.

[11] Patent Number: 6,067,826

[45] Date of Patent: May 30, 2000

[54] DOOR LOCK ACTUATOR

[75] Inventors: John C. Holloway, Cumberland, R.I.; Thomas P. Schregardus, Somerville, Mass.; Thomas L. Rorabacher, Livonia; Francis Hlavaty, Novi, both of Mich.

[73] Assignee: Stoneridge, Inc., Warren, Ohio

[21] Appl. No.: 09/329,847

[22] Filed: Jun. 11, 1999

Related U.S. Application Data

[60] Provisional application No. 60/088,910, Jun. 11, 1998.

[51] Int. Cl.[7] ..... E05B 47/06

[52] U.S. Cl. ..... 70/278.3; 70/279.1; 70/283.1; 292/201

[58] Field of Search ..... 70/190, 191, 264, 70/277, 278.2, 278.3, 278.7, 279.1, 283.1; 292/144, 201, 51, 112, 142, 160, 172

[56] References Cited

U.S. PATENT DOCUMENTS

| | | | |
|---|---|---|---|
| 3,991,595 | 11/1976 | Bahry et al. | 292/142 X |
| 5,007,261 | 4/1991 | Quantz | 292/201 X |
| 5,083,448 | 1/1992 | Kärkkäinen et al. | 70/277 |
| 5,419,596 | 5/1995 | Okada et al. | 292/201 |
| 5,474,338 | 12/1995 | Büscher | 292/201 |
| 5,603,537 | 2/1997 | Amano et al. | 292/201 |
| 5,697,237 | 12/1997 | Dilger et al. | 70/264 |

*Primary Examiner*—Lloyd A. Gall
*Attorney, Agent, or Firm*—Kenway & Crowley

[57] ABSTRACT

A door lock actuator including a single non-reversible drive motor for generating step-wise rotation of an output shaft through an indexing assembly which is decoupled from the motor during periods of operation. The indexing assembly includes an index pin plate coupled to a drive gear for rotation therewith. The plate includes a plurality of spaced pins which are positioned to contact a rotating paddle driven by the drive motor. The paddle successively contacts the pins in a portion of its rotation to cause corresponding rotation of the drive gear and the output gear which is meshingly engaged therewith. The output gear is coupled to an output shaft having twin cams positioned thereon for manipulating door latch pawls to control the door lock state. An override mechanism is provided which includes top and bottom override arms driven by rotation of a key in the key cylinder. The top override arm can be activated to place the output cams in a "double unlock" condition, while the bottom override arm can be activated to place the output cams in a "double lock" position.

20 Claims, 3 Drawing Sheets

DOOR LOCK ACTUATOR

CROSS REFERENCE TO RELATED APPLICATIONS

The present application claims the benefit of the filing date of U.S. Provisional Application No. 60/088,910, filed Jun. 11, 1998, the teachings of which are incorporated herein by reference.

FIELD OF THE INVENTION

The present invention relates in general to an actuator, and, in particular to a door lock actuator for selective positioning of an automobile locking door latch.

BACKGROUND OF THE INVENTION

Electro-mechanical actuators are commonly used in automobiles for the purpose of manipulating locking door latches. Actuators in this application are typically user-operated by rotation of a key in the door key cylinder. Key rotation causes the motor-driven actuator to physically vary the door lock state by manipulation of various door lock levers.

For example, in a typical double-locking door latch, the door handle inside the vehicle and the door handle outside of the vehicle may be locked/unlocked independently of each other. This is accomplished by means of actuator manipulation of adjacent lock pawls which act against respective latch levers. In an "unlock" mode, the pawls push directly against the latch levers, and in a "lock" mode, the pawls are lifted up (e.g., rotated about a pin) to slide past the engagement surfaces of the latch levers.

Unfortunately, prior art door lock actuators have proven to be cumbersome, costly, and inefficient in design. One reason for this is that prior art designs require incorporation of either a reversible drive motor capable of driving the actuator in two directions of rotation, a separate drive motor for each direction of rotation, or a separate drive motor for each lock pawl. However, reversible drive motors are relatively expensive compared to non-reversible motors, and the combination of two drive motors results in a physically large actuator assembly which may be difficult to incorporate into limited space. Prior art designs have also failed to provide reliable manual override systems for allowing manipulation of the door lock in the event of total loss of electrical power. In some cases, prior art manual override systems require excessive force to activate, or are ineffective due to inappropriate physical positioning of the lock pawls.

Accordingly, there is a need in the art for a cost-effective, compact, and reliable door lock actuator. There is also a need in the art for door lock actuator with a reliable and effective manual override mechanism.

OBJECTS OF THE INVENTION

Thus, it is an object of the present invention to provide a cost-efficient, compact, and reliable door lock actuator.

It is another object of the present invention to provide a door lock actuator with a reliable and effective manual override mechanism.

It is another object of the present invention to provide a door lock actuator with a single non-reversible drive motor.

Another object of the present invention is to provide a door lock actuator with a single rotary output shaft.

Yet another object of the invention is to provide a door lock actuator with the motor decoupled from the gear train in all lock actuator positions.

Still another object of the invention is to provide a door lock actuator with indexing output cam operation to provide positional accuracy of lock actuating cams.

A further object of the invention is to provide a door lock actuator with motor coast compensation resulting from decoupling of the motor with the gear train.

Still a further object of the invention is to provide a door lock actuator with separate resetting mechanical override for the door lock/unlock mechanisms.

Yet a further object of the invention is to provide a door lock actuator with a self-healing mechanical override.

These and other objects of the present invention will become apparent from a review of the description provided below.

SUMMARY OF THE INVENTION

The present invention is organized about the concept of providing a door lock actuator which is compact, reliable, and cost-effective. The actuator may incorporate a single non-reversible drive motor for generating step-wise rotation of an output shaft through an indexing assembly which is decoupled from the motor during periods of operation. The indexing assembly includes an index pin plate coupled to a drive gear for rotation therewith. The plate includes a plurality of spaced pins which are positioned to contact a rotating paddle driven by the drive motor. The paddle successively contacts the pins in a portion of its rotation to cause corresponding rotation of the drive gear and the output gear which is meshingly engaged therewith. The output gear is coupled to an output shaft having twin cams positioned thereon for manipulating door latch pawls to control the door lock state. An override mechanism is provided which includes top and bottom override arms driven by rotation of a key in the key cylinder. The top override arm can be activated to place the output cams in a "double unlock" condition, while the bottom override arm can be activated to place the output cams in a "double lock" position.

In particular, one embodiment an actuator according to the invention may include: a drive motor having an output shaft with an output gear coupled thereto; a paddle coupled to the output gear for rotation therewith; an indexing pin plate having a plurality of pins, e.g., eight pins, including at least one top override pin, extending from a top thereof for successive contact with the paddle upon rotation of the paddle; a drive gear adapted for rotation with the indexing pin plate, the drive gear having at least one bottom override pin extending from a bottom thereof, an output shaft with an output gear mounted thereon and at least one output cam mounted to an end thereof, the output shaft being coupled to the drive gear for rotation upon rotation of the drive gear; and top and bottom override arms coupled to an output shaft of a key cylinder for movement upon rotation of the key cylinder, the top override arm having an end adapted for contacting the at least one top override pin, and the bottom override arm having an end adapted for contacting the at least one bottom override pin.

Upon rotation of the key cylinder in a first range of angular rotation, e.g., in the first 30 degrees of rotation in either direction, an electrical power source is connected to energize the drive motor, thereby causing rotation of the paddle and contact of the paddle with successive ones of the plurality of indexing pins for rotating the output shaft and the at least one cam through the drive gear and the output gear. With rotation of the key cylinder in a second range of rotation, e.g., between 30 and 90 degrees in a first direction, the top override arm contacts the at least one top override pin for thereby rotating the output shaft and the at least one cam to a first position, e.g., "double unlock", through the drive gear and the output gear. Upon rotation of the key cylinder in a third range of rotation, e.g., between 30 and 90 degrees in a second direction, the bottom override arm contacts the at least one bottom override pin for thereby rotating the output shaft and the at least one cam to a second position, e.g., "double lock", through the drive gear and the output gear.

In one embodiment the indexing pin plate may have eight equally spaced ones of the indexing pins extending therefrom, wherein two of the indexing pins are top override pins spaced 180 degrees apart on the indexing pin plate. The perimeter of the indexing pin plate may define a plurality, e.g., eight, of equally spaced detent spring recesses disposed between a plurality of equally spaced radiused lobes. A detent spring may be positioned to engage successive ones of the detent spring recesses upon rotation of the pin plate by the paddle. To allow for desired positioning of the cams in an override condition, indexing pins may be positioned on the plate so that four of the indexing pins are disposed on each side of a center line of the indexing pin plate when the detent spring is disposed in one of the detent spring recesses.

The top override arm may be coupled to the key cylinder by an upwardly extending pin adjacent an end of the override arm which extends through a slot in a top link arm joined to the key cylinder drive shaft. Upon rotation of the key cylinder shaft in the second range of rotation, the override arm is pulled toward the key cylinder for contacting the at least one top override pin. Similarly the bottom override arm may be coupled to the key cylinder drive shaft by an upwardly extending pin adjacent an end of the bottom override arm which extends through a slot in a bottom link arm joined to the shaft. Upon rotation of the key cylinder shaft in the third range of rotation, the override arm is forced away from the key cylinder for contacting the at least one bottom override pin.

BRIEF DESCRIPTION OF THE DRAWING

For a better understanding of the present invention, together with other objects, features and advantages, reference should be made to the following detailed description which should be read in conjunction with the following figures wherein like numerals represent like parts.

DETAILED DESCRIPTION OF THE INVENTION

Figure 1:
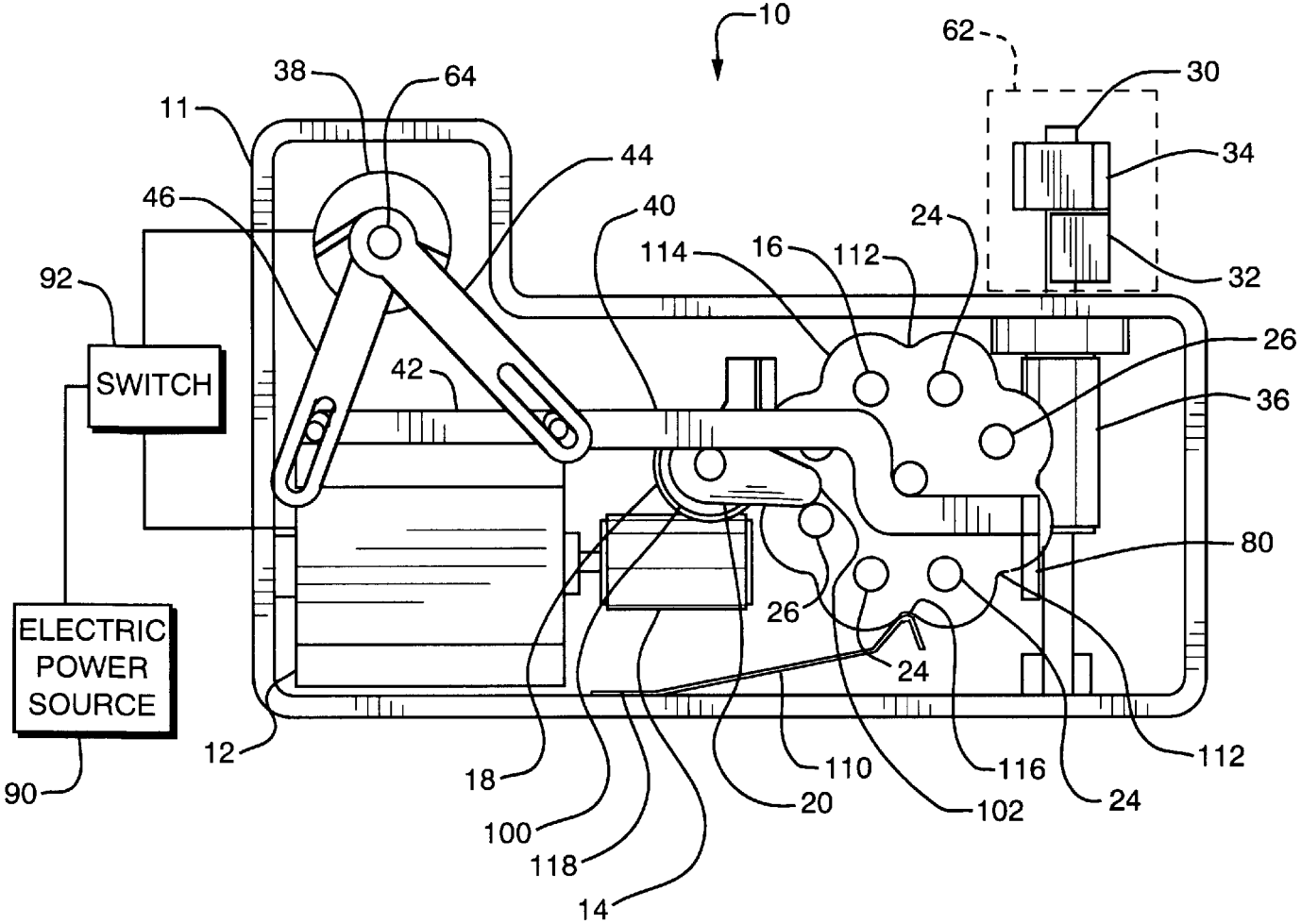
FIG. 1 is a top view of an exemplary actuator according to the invention.
Figure 2:
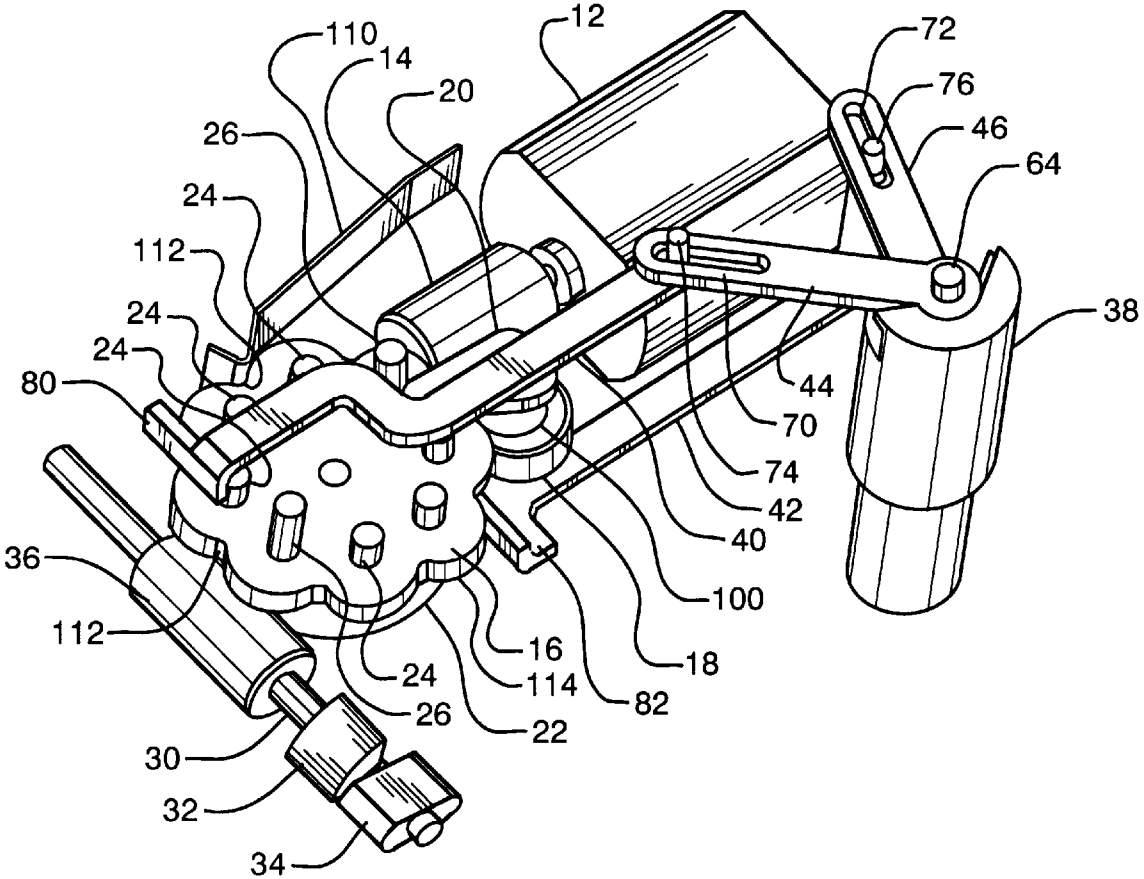
FIG. 2 is perspective view of a portion of the exemplary actuator illustrated in FIG. 1.

Referring now to FIGS. 1 and 2, the invention will first be described in broad general terms, with a more detailed description to follow. As shown, an exemplary actuator 10 in accordance with the present invention includes: a housing 11, a drive motor 12 with an output gear 14 coupled to the motor by a first output shaft; an index assembly including an indexer gear 18, a paddle 20, a drive gear 22, an indexing pin plate 16 with indexing pins 24 and top override pins 26, 26', and bottom override pins 28 (FIG. 3) extending from the bottom of the drive gear 22; an output gear 36 in meshing engagement with the drive gear 22 for driving an output shaft 30 with twin output cams 32, 34; and a key cylinder 38 with top 40 and bottom 42 manual override arms connected to first 44 and second 46 link arms, respectively.

The actuator is driven by the drive motor in response to rotation of a key 60 (FIG. 3) in an appropriate key slot (not shown) of the key cylinder 38. The output gear 14 on the drive motor output shaft meshingly engages the indexer gear 18, causing rotation thereof, e.g., clockwise in FIG. 1. The indexing paddle 20 disposed on the top of the indexer gear rotates with the indexer gear and contacts successive ones of the indexing pins 24 or top override pins 26, causing step-wise rotation of the plate 16 and the drive gear 22. The drive gear 22 meshingly engages the output gear 36 causing rotation of the output shaft 30.

The twin output cams 32,34 are mounted adjacent to each other on the output shaft, and are spaced to mate with the latch pawls (not shown) on the door latch 62. The cams rotate as unit, driven by the drive gear 22. As the cams rotate, they contact the side-by-side lock pawls in the mating door latch 62. The pawls act against the latch levers in a manner known in the art to change the door lock/unlock state. For example, in a conventional "double-locking" door latch, the sequence of pawl lifting is fixed, and follows the cam position truth table provided below.

| Cam Position | Inside Lock Pawl | Outside Lock Pawl |
|---|---|---|
| 1 | Lifts to Lock | Remains in Unlock |
| 2 | Remains in Lock | Lifts to Lock |
| 3 | Drops to Unlock | Remains in Lock |
| 4 | Remains in Unlock | Drops to Unlock |

In the unlocked mode, the pawls push directly against the latch levers. In the lock mode, the pawls are lifted up to slide past the engagement surfaces of the latch levers. According to the present invention, the output cams 32, 34 rotate in one direction only. Accordingly, if the cams are in position 3, and position 2 is desired, the actuator must cycle through positions 4 and 1 before the cams reach position 2. Motor reversing is, therefore, not required to operate the actuator.

In the event of a complete loss of electrical power the actuator may be manually operated by rotation of the key 60 in the key cylinder. In manual mode, rotation of the key in the key cylinder causes rotation of the key cylinder drive shaft 64 to which a first end of the first 44 and second 46 link arms are connected. Opposite ends of the first and second link arms include a slot 70, 72 for receiving upward extending pins 74,76 on a first end of the top 40 and bottom 42 override arms, respectively. With rotation of the shaft 64, the override arms 40, 42 are moved substantially linearly with the pins 74, 76 traveling along the lengths of the slots 70, 72.

The top override arm has a downwardly extending portion 80 at its distal end which is positioned above the indexing pin plate 16. In one direction of key rotation, the top manual override arm is forced linearly in the direction of the key cylinder, whereby the downwardly extending portion 80 may contact one of the top override pins, e.g., pin 26, to rotate the drive gear, e.g., clockwise in FIG. 1, and reset the door lock to the "double lock" position. In an opposite direction of key rotation the bottom override arm is forced linearly in a direction away from the key cylinder. An upwardly extending portion of the bottom override arm 82 is thus forced into contact with one of the bottom override pins 28 (FIG. 3) to rotate the drive gear 22 and reset the door lock to the "double unlock" position.

With continued reference to FIGS. 1 and 2, the illustrated embodiment will now be described in further detail. Those skilled in the art will recognize that a variety of drive motors may be used. In one embodiment, however, the actuator may be driven by a fractional horsepower permanent magnet DC motor, e.g., through output gear 14. The motor 12 is energized by an electrical power source 90, e.g., the vehicle battery, through a switch 92 controlled by rotation of a key 60 in the key cylinder. Advantageously, the present invention provides for a non-reversible motor, allowing the entire drive mechanism to rotate in one direction only.

The output gear 14 may be a worm gear for meshingly engaging the indexer gear 18 and driving the indexing assembly. The indexing paddle 20 is disposed on the indexer gear, e.g., with a spacer 100, for rotation therewith, and has a distal end 102 which is positioned for engaging the indexing 24 and override pins 26 mounted to the indexing pin plate 16. The pin plate 16 is coupled to the drive gear 22 so that the plate and the gear rotate together, and may be formed integrally with the drive gear or as a separate part which is fastened to the drive gear. In the illustrated embodiment, eight pins, i.e., six indexing pins 24 and two override pins 26, 26', are located on the upper surface of the plate 16 so that the paddle 20 will move the plate 16 and the drive gear ⅛ of a turn for each full rotation of the indexing gear 18.

Rotation of the plate and drive gear by the paddle is accomplished against the bias of the detent spring 110 which is adapted to engage successive detent spring recesses 112 in the plate. As shown, the plate may be generally circular with eight radiused lobes 114 on its perimeter separated by eight detent spring recesses 112 spaced at 45 degrees apart to match up with the eight pins extending from the top of the plate. The detent spring 110 has a first end 118 anchored on the housing 11 (FIG. 1), and a second end 116 which rides against the perimeter of the plate 16 and drops into detent spring recesses 112 at specific positions that correspond to the required positions for the output cams.

In this arrangement, step-wise rotation of the drive gear is achieved with the paddle 20 engaging indexing or override pins for only about 50 degrees of indexing gear rotation. For the balance of the indexing gear rotation, the paddle is in free space between adjacent pins, and the detent spring holds the drive gear in position until the paddle rotates around again to impact the next pin. Advantageously, this feature decouples the motor from the drive train and reduces the force required to cycle the override mechanism. This feature also makes the positioning of the output cams easier since the paddle 20 rotates the plate 16 and the drive gear to a defined position then disengages from the plate.

The output shaft 30 is driven by the mating of the drive gear 22 and the output gear 36, which may be crossed shaft helical gears. In the illustrated embodiment the output shaft 30 rotates once for every ½ turn of the drive gear 22 to accommodate the design of the override mechanism. Those skilled in the art will, however, recognize that a different relative rotation may be required depending on the particular application. In one embodiment, however, the output gear 36 may be a high helix angle involute crossed shaft helical gear to provide the 1:2 speed ratio change between the drive gear 22 and the output shaft 30. This arrangement also provides a right angle direction change allowing the cams 32, 34 to interface with the door latch pawls.

The override mechanism is a mechanical linkage of the output shaft 64 of the key cylinder 38 with top 40 and bottom 42 override arms through top 44 and bottom 46 link arms. As indicated above, substantially linear motion is achieve in the override arms by travel of override arm pins 74, 76 in the slots 70, 72 of the link arms 44, 46 as the link arms pivot about the shaft 64. The override mechanism allows the actuator to be mechanically operated by the key 60 in the event of a total loss of power.

In a first range of key cylinder rotation, e.g., the first 30 degrees of rotation in either direction, the electrical switch 92 activates the actuator motor drive by connecting an electric power source 90, e.g., the vehicle battery, thereto. In a second range of motion, e.g., between 30 degrees and 90 degrees in one direction, the top override arm 40 is activated, and in a third range of motion, e.g., between 30 degrees and 90 degrees in an opposite direction, the bottom override arm is activated. Thus, there is 30 degrees of lost motion in both directions between the key cylinder and the override mechanism.

In normal operation, the drive motor rotates the drive gear 22 in a counter-clockwise direction when looking at it from above in FIG. 1. The top override arm 40 is situated so that, upon rotation of the key in the key cylinder, the downwardly extending portion 80 engages one of the top override pins 26, 26' to cause clock-wise rotation of the drive gear. The top override pins 26, 26' are located on the plate so that when the top override mechanism is activated, the drive gear is rotated to "double lock" cam position. The override pins 26, 26' are positioned 180 degrees apart to provide the override interface for each half of the drive gear rotation. After activation, a torsion return spring in the key cylinder 38 resets the position of the override mechanism.

The bottom override mechanism functions similarly, but interfaces with one of the two override pins 28 on the bottom of the drive gear. The upwardly extending portion 82 of the bottom override rotates the drive gear in a clock-wise direction by engaging a bottom override pin 28. The bottom override pins are disposed at 180 degrees out of phase with the top override pins. When activated, the bottom override mechanism moves the drive gear to a "double unlock" cam position.

In the preferred embodiment, the positioning of the indexing and override pins on the plate 16 allows for one full output cam rotation to occur within 180 degrees of rotation on the drive gear 22. This fact, and the location of the pins on the plate, allows for a substantially linear pull on the override mechanism to reset the actuator. In the illustrated embodiment, the first pin 24' is referenced at about 22.5 degrees below the plate/drive gear centerline and subsequent pins, 24", 24''', 26 are about 45 degrees clock-wise from this position. This places pins 24', 24", 24''' and 26 all above the centerline, so that the override arm 40 can pull the override pin 26 from the first position at 22.5 degrees (worst case) to the final position, i.e., lock at 157.5 degrees as shown. If the override pin is in an intermediate position between 22.5 degrees and 157.5 degrees, then the override arm 40 "free-wheels" until it contacts the override pin to pull it to the 157.5 degree "double lock" cam position.

Figure 3:
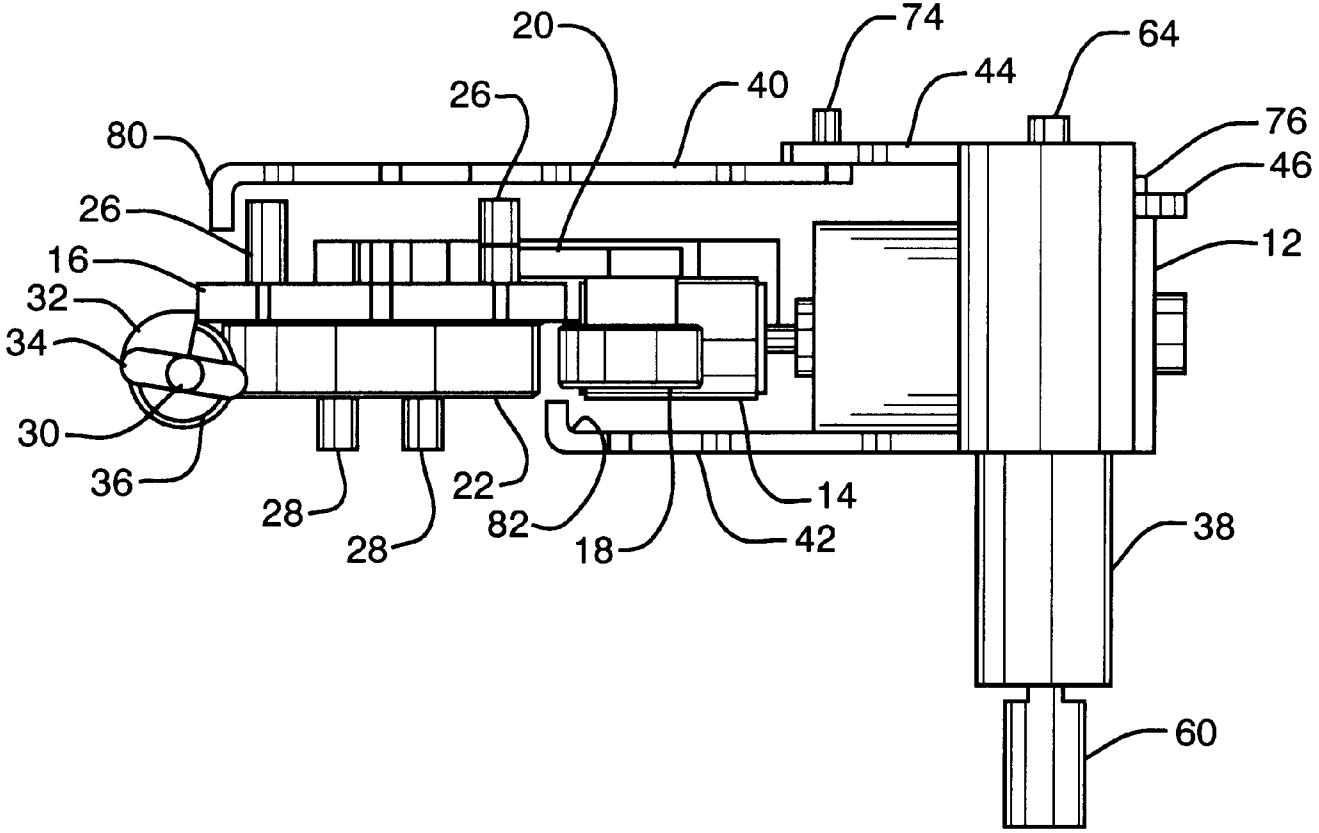
FIG 3 is a side view of a portion of the exemplary actuator illustrated in FIG. 1.

This arrangement requires symmetry in the indexing and override pin pattern about the centerline of the plate so the function is the same for each 180 degree segment of the plate. A similar configuration is on the bottom of the drive gear, but only the two bottom override pins 28 are required, as illustrated in FIG. 3. The bottom override pins have the same angular reference to the plate/drive gear centerline, but are located to result in a "double unlock" condition as opposed to the "double lock" position for the top override pins.

Advantageously, the override mechanism resets the actuator by rotating the drive gear in a clock-wise direction. This is opposite to the normal counter-clock-wise rotation of the drive gear when driven by the drive motor 12. Thus, in the unlikely event of the return spring not resetting the override arms, if the actuator is driven by the motor after a manual override, the override arms will be rotated back to a "reset" position by the clock-wise rotating override pins. Thus, a self-healing function is provided if there is a malfunction in the key cylinder return spring.

There is thus provided a door lock actuator which is compact, reliable, and cost-effective. The actuator incorporates a single non-reversible drive motor for generating step-wise rotation of an output shaft through an indexing assembly which is decoupled from the motor during periods of operation. The indexing assembly includes an index pin plate coupled to a drive gear for rotation therewith. The plate includes a plurality of spaced pins which are positioned to contact a rotating paddle driven by the drive motor. The paddle successively contacts the pins in a portion of its rotation to cause corresponding rotation of the drive gear and the output gear which is meshingly engaged therewith. The output gear is coupled to an output shaft having twin cams positioned thereon for manipulating door latch pawls to control the door lock state. An override mechanism is provided which includes top and bottom override arms driven by rotation of a key in the key cylinder. The top override arm can be activated to place the output cams in a "double unlock" condition, while the bottom override arm can be activated to place the output cams in a "double lock" position.

The embodiments which have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention as defined in the appended claims.

What is claimed is:

1. A door lock actuator for manipulating the lock state of an automotive door comprising:

a drive motor having a first output shaft with a first output gear coupled thereto;

a paddle coupled to said output gear for rotation therewith;

an indexing pin plate having a plurality of pins extending from a top thereof, said plurality of pins including at least one top override pin and being positioned on said plate for successive contact with said paddle upon rotation of said paddle;

a drive gear adapted for rotation with said indexing pin plate, said drive gear having at least one bottom override pin extending from a bottom thereof;

a second output shaft with a second output gear mounted thereon and at least one output cam mounted to an end thereof, said second output shaft being coupled to said drive gear for rotation upon rotation of said drive gear; and top and bottom override arms coupled to a drive shaft of a key cylinder for movement upon rotation of said key cylinder, said top override arm having an end adapted for contacting said at least one top override pin, and said bottom override arm having an end adapted for contacting said at least one bottom override pin;

wherein upon rotation of said key cylinder in a first range of angular rotation an electrical power source is connected to energize said drive motor, thereby causing rotation of said paddle and contact of said paddle with successive ones of said plurality of indexing pins, said paddle thereby rotating said second output shaft and said at least one cam through said drive gear and said second output gear, and wherein upon rotation of said key cylinder in a second range of rotation said top override arm contacts said at least one top override pin for thereby rotating said second output shaft and said at least one cam to a first position through said drive gear and said second output gear; and wherein upon rotation of said key cylinder in a third range of rotation said bottom override arm contacts said at least one bottom override pin for thereby rotating said second output shaft and said at least one cam to a second position through said drive gear and said second output gear.

2. A door lock actuator according to claim 1, wherein said indexing pin plate has eight equally spaced ones of said indexing pins extending therefrom, and wherein two of said indexing pins are top override pins spaced 180 degrees apart on said indexing pin plate.

3. A door lock actuator according to claim 1, wherein the perimeter of said indexing pin plate defines a plurality of equally spaced detent spring recesses disposed between a plurality of equally spaced radiused lobes, and wherein said actuator includes a detent spring, said detent spring being positioned to engage successive ones of said detent spring recesses upon rotation of said pin plate by said paddle.

4. A door lock actuator according to claim 3, wherein the perimeter of said indexing pin plate includes eight equally spaced detent spring recesses disposed between eight equally spaced radiused lobes, and wherein said indexing pin plate has eight equally spaced ones of said indexing pins extending therefrom, and wherein two of said indexing pins are top override pins spaced 180 degrees apart on said indexing pin plate.

5. A door lock actuator according to claim 4, wherein said indexing pins are positioned on said plate so that four of said indexing pins are disposed on each side of a center line of said indexing pin plate when said detent spring is disposed in one of said detent spring recesses.

6. A door lock actuator according to claim 1, wherein one-half rotation of said drive gear causes one rotation of said second output gear.

7. A door lock actuator according to claim 1, wherein two of said bottom override pins extend from the bottom of said drive gear.

8. A door lock actuator according to claim 7, wherein said bottom override pins extend from said bottom of said drive gear at positions which are 180 degrees apart.

9. A door lock actuator according to claim 1, wherein said top override arm is coupled to said key cylinder drive shaft through a top link arm, said top override arm having an upwardly extending pin adjacent an end thereof which extends through a slot in said top link arm for sliding movement along said slot, and wherein upon rotation of said key cylinder shaft in said second range of rotation said top override arm is pulled toward said key cylinder for contacting said at least one top override pin.

10. A door lock actuator according to claim 1, wherein said bottom override arm is coupled to said key cylinder drive shaft through a bottom link arm, said bottom override arm having an upwardly extending pin adjacent an end thereof which extends through a slot in said bottom link arm for sliding movement along said slot, and wherein upon rotation of said key cylinder shaft in said third range of rotation said bottom override arm is forced away from said key cylinder for contacting said at least one bottom override pin.

11. A door lock actuator for manipulating the lock state of an automotive door comprising:

an indexing pin plate having a plurality of pins extending from a top thereof, said plurality of pins including at least one top override pin;

a drive gear adapted for rotation with said indexing pin plate, said drive gear having at least one bottom override pin extending from a bottom thereof;

an output shaft with an output gear mounted thereon and at least one output cam mounted to an end thereof, said output shaft being coupled to said drive gear for rotation upon rotation of said drive gear; and top and bottom override arms coupled to a drive shaft of a key cylinder for movement upon rotation of said key cylinder, said top override arm having an end adapted for contacting said at least one top override pin, and said bottom override arm having an end adapted for contacting said at least one bottom override pin;

wherein upon rotation of said key cylinder in a first range of rotation said top override arm contacts said at least one top override pin for thereby rotating said output shaft and said at least one cam to a first position through said drive gear and said output gear; and wherein upon rotation of said key cylinder in a second range of rotation said bottom override arm contacts said at least one bottom override pin for thereby rotating said output shaft and said at least one cam to a second position through said drive gear and said output gear.

12. A door lock actuator according to claim 11, wherein said indexing pin plate has eight equally spaced ones of said indexing pins extending therefrom, and wherein two of said indexing pins are top override pins spaced 180 degrees apart on said indexing pin plate.

13. A door lock actuator according to claim 11, wherein the perimeter of said indexing pin plate defines a plurality of equally spaced detent spring recesses disposed between a plurality of equally spaced radiused lobes, and wherein said actuator includes a detent spring, said detent spring being positioned to engage successive ones of said detent spring recesses upon rotation of said pin plate by a paddle.

14. A door lock actuator according to claim 13, wherein the perimeter of said indexing pin plate includes eight equally spaced detent spring recesses disposed between eight equally spaced radiused lobes, and wherein said indexing pin plate has eight equally spaced ones of said indexing pins extending therefrom, and wherein two of said indexing pins are top override pins spaced 180 degrees apart on said indexing pin plate.

15. A door lock actuator according to claim 14, wherein said indexing pins are positioned on said plate so that four of said indexing pins are disposed on each side of a center line of said indexing pin plate when said detent spring is disposed in one of said detent spring recesses.

16. A door lock actuator according to claim 11, wherein one-half rotation of said drive gear causes one rotation of said output gear.

17. A door lock actuator according to claim 11, wherein two of said bottom override pins extend from the bottom of said drive gear.

18. A door lock actuator according to claim 18, wherein said bottom override pins extend from said bottom of said drive gear at positions which are 180 degrees apart.

19. A door lock actuator according to claim 11, wherein said top override arm is coupled to said key cylinder drive shaft through a top link arm, said top override arm having an upwardly extending pin adjacent an end thereof which extends through a slot in said top link arm for sliding movement along said slot, and wherein upon rotation of said key cylinder shaft in said first range of rotation said top override arm is pulled toward said key cylinder for contacting said at least one top override pin.

20. A door lock actuator according to claim 11, wherein said bottom override arm is coupled to said key cylinder drive shaft through a bottom link arm, said bottom override arm having an upwardly extending pin adjacent an end thereof which extends through a slot in said bottom link arm for sliding movement along said slot, and wherein upon rotation of said key cylinder shaft in said second range of rotation said bottom override arm is forced away from said key cylinder for contacting said at least one bottom override pin.

* * * * *